US009254679B2

(12) United States Patent
Kojima

(10) Patent No.: US 9,254,679 B2
(45) Date of Patent: Feb. 9, 2016

(54) RECORDING DEVICE AND WORKPEICE-ADVANCING/RETRACTING METHOD FOR RECORDING DEVICE

(75) Inventor: Kenji Kojima, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 874 days.

(21) Appl. No.: 13/196,092

(22) Filed: Aug. 2, 2011

(65) Prior Publication Data

US 2012/0042799 A1 Feb. 23, 2012

(30) Foreign Application Priority Data

Aug. 20, 2010 (JP) ..... 2010-185426

(51) Int. Cl.

| | |
|---|---|
| ***B41F 1/28*** | (2006.01) |
| ***B41J 3/28*** | (2006.01) |
| ***B41J 11/00*** | (2006.01) |
| ***B41J 11/06*** | (2006.01) |
| ***B41J 15/04*** | (2006.01) |

(52) U.S. Cl.

CPC ..... *B41J 3/28* (2013.01); *B41J 11/0085* (2013.01); *B41J 11/06* (2013.01); *B41J 15/04* (2013.01)

(58) Field of Classification Search

CPC ..... B41J 13/226

USPC ..... 399/305; 101/474

See application file for complete search history.

(56) References Cited

FOREIGN PATENT DOCUMENTS

| | | | |
|---|---|---|---|
| JP | 2002-225255 | A | 8/2002 |
| JP | 2004-307122 | A | 11/2004 |
| JP | 3640868 | B2 | 4/2005 |
| JP | 2007-039231 | A | 2/2007 |
| JP | 2009-276522 | A | 11/2009 |

*Primary Examiner* — Matthew G Marini

(74) *Attorney, Agent, or Firm* — Global IP Counselors, LLP

(57) ABSTRACT

A recording device includes a workpiece stage that holds by suction a recording region of an elongated workpiece fed in a first feed direction, a recording unit that carries out recording in the recording region, a workpiece-holding unit arranged on a downstream side of the workpiece stage in the feed direction, and immovably holds or releases a part of the workpiece, an advancing/retracting unit that causes the workpiece stage and the workpiece-holding unit to travel relatively apart in an extension direction of the workpiece, and a control unit that controls the individual configurations. The control unit performs a recording operation, a holding operation for immovably holding part of the workpiece, and an advancing/retracting operation for retracting from the workpiece stage the recording region where recording has been completed and advancing onto the workpiece stage the recording region where recording has yet to occur.

8 Claims, 11 Drawing Sheets

(d)

(e)

(f)

(g)

(h)

(i)

RECORDING DEVICE AND WORKPEICE-ADVANCING/RETRACTING METHOD FOR RECORDING DEVICE

CROSS-REFERENCE TO RELATED APPLICATIONS

This application claims priority to Japanese Patent Application No. 2010-185426 filed on Aug. 20, 2010. The entire disclosure of Japanese Patent Application No. 2010-185426 is hereby incorporated herein by reference.

BACKGROUND

1. Technical Field

The present invention relates to a recording device adapted to carry out recording of a recording region of a workpiece of continuous length which is delivered to a worktable and held thereon by suction, and to a workpiece-advancing/retracting method therefor.

2. Related Art

One recording device known in the prior art is provided with a suction table for delivering a workpiece of continuous length (roll-fed paper) in a first direction from a tape supply mechanism to a tape windup mechanism, and holding by suction a recording region of the delivered workpiece; a drawing device for carrying out drawing that carries out drawing in the recording region; and a tape feed mechanism having a paper feed roller disposed towards the tape wind-up mechanism for conveying the workpiece in a first direction, and a tension roller disposed towards the tape supply mechanism for imparting prescribed tension to the workpiece on the suction table (see Japanese Laid-Open Patent Application Publication No. 2002-225255).

With this recording device, after prescribed recording has terminated, the workpiece, which has been released from holding on the suction table, travels downstream through driving of the paper feed roller, whereby the recording region which is finished being recorded retracts and an as-yet-unrecorded recording region advances onto the suction table (advance/retract operation).

SUMMARY

However, with the recording device described previously, since the advancing/retracting operation is carried out by driving the paper feed roller, structural issues make it difficult for f the workpiece to be fed (the advancing/retracting operation) with high accuracy due to slippage in relation to the workpiece, or deformation of the paper feed roller. In particular, a problem has been presented in terms of diminished performance in the advancing/retracting operation due to deterioration over time of the paper feed roller and the tension roller.

It is an object of the present invention to provide a recording device and a workpiece-advancing/retracting method therefor, whereby the recording region of an elongated workpiece can be advanced in the incoming and outgoing directions with good accuracy.

A recording device according to a first aspect of the present invention includes a workpiece stage, a recording unit, a workpiece-holding unit, an advancing/retracting unit and a control unit. The workpiece stage is configured and arranged to hold by suction a recording region of an elongated workpiece fed in a first feed direction. The recording unit is configured and arranged to carry out recording in the recording region held onto the workpiece stage by suction. The workpiece-holding unit is arranged on a downstream side of the workpiece stage in the first feed direction, and configured and arranged to immovably hold or release a part of the workpiece. The advancing/retracting unit is configured and arranged to cause the workpiece stage and the workpiece-holding unit to travel relatively apart in an extension direction of the workpiece. The control unit is configured to control the recording unit, the workpiece-holding unit, and the advancing/retracting unit to perform a recording operation to carry out recording in the recording region, a holding operation to immovably hold the part of the workpiece subsequent to the recording operation, and an advancing/retracting operation to cause the workpiece stage and the workpiece-holding unit to travel in a relative manner in the extension direction subsequent to the holding operation so that the recording region where recording has been completed is retracted from the workpiece stage and the recording region where recording has yet to occur is advanced onto the workpiece stage.

A workpiece-advancing/retracting method according to another aspect is a method for advancing/retracting a workpiece for a recording device in which a workpiece-holding unit is used for immovably holding an elongated workpiece. The workpiece-advancing/retracting method includes: positioning on a workpiece stage a recording region of a workpiece fed in a first feed direction, and performing recording; subsequent to the recording, immovably holding a part of the workpiece by the workpiece-holding unit on a downstream side of the workpiece stage in the first feed direction; and subsequent to the holding of the part of the workpiece, causing the workpiece stage and the workpiece-holding unit to travel in a relative manner in an extension direction of the workpiece, so that the recording region where recording has been completed retracts from the workpiece stage and the recording region where recording has yet to occur is advanced onto the workpiece stage.

According to the aspects described above, by causing relative travel between the workpiece-holding unit and the workpiece stage in a state in which part of the workpiece is held by the workpiece-holding unit, the workpiece (recording region) is simultaneously caused to advance and retract with respect to the stage. In other words, by causing relative travel to occur in a state with part of the workpiece held, no slippage whatsoever is produced between the workpiece and the workpiece-holding unit. Specifically, the workpiece can be reliably caused to travel over a distance necessary to advance or retract. In so doing, the recording region that has finished being recorded and an unrecorded recording region can respectively retract or advance with respect to the workpiece stage in a reliable and highly accurate manner.

In the recording device, the control unit, between the holding operation and the advancing/retracting operation, is preferably configured to perform a suction-releasing operation to release holding by suction of the recording region.

According to this configuration, the advancing towards and retracting from the workpiece stage can be carried out without applying unnecessary tension to the workpiece.

Also, the recording device preferably further includes nip sections configured and arranged to impart a prescribed tension to the workpiece approaching the workpiece stage, the nip sections being respectively lined up in the extension direction at both ends of the workpiece stage in the extension direction, and a raising/lowering unit configured and arranged to cause upper parts of the nip sections to rise or fall between a lowered position that is a position coplanar with an upper face of the workpiece stage and a raised position that is above the lowered position. Subsequent to the suction-releasing operation, the control unit is preferably configured to cause the nip sections to travel to the raised position, and to perform a separation operation to separate the recording region from the workpiece stage.

According to the aspect described above, as a result of being separated from (caused to float above) the workpiece stage, the workpiece (recording region) can be caused to advance or retract without suffering striation or other types of damage.

Additionally, at the lowered position, the nip sections line up in the extension direction, and are approximately coplanar with the upper face of the workpiece stage. Because of this, flatness of the workpiece can be maintained not just in the region where the workpiece is held by suction on the workpiece stage, but all the way between the position where the workpiece is nipped by one nip sections and the position where the workpiece is nipped by the other nip section. In other words, a wide recording region can be ensured.

In the recording device, in the advancing/retracting operation, the control unit is preferably configured to immobilize the workpiece stage, and to cause the workpiece-holding unit to travel.

Alternatively, in the recording device, in the advancing/retracting operation, the control unit is preferably configured to immobilize the workpiece-holding unit, and to cause the workpiece stage to travel.

According to the aspects described above, accuracy of the advancing/retracting operation (feeding) of the workpiece can be ensured by the accuracy of travel of the workpiece anchoring means or travel accuracy of the workpiece stage. In so doing, a high level of feed accuracy can be readily ensured, and accuracy may be improved, particularly as compared with the level of feed accuracy attained with rollers and an encoder or the like.

The recording device preferably further includes a supply/recovery unit configured and arranged to feed the workpiece to the workpiece stage in a reel-to-reel format, the supply/recovery unit including a wind-up device having a wind-up reel configured and arranged to wind up the workpiece, and a wind-up-side buffer mechanism configured and arranged to buffer, with respect to the workpiece stage, the workpiece to be wound onto the wind-up reel.

According to the aspect described above, the workpiece having been fed to the downstream end in the feed direction can be absorbed by the wind-up-side buffer mechanism, and therefore the advancing/retracting operation can be carried out without the need for the fed workpiece to be wound on the wind-up reel. Moreover, the workpiece can be wound up onto the wind-up reel without imparting excess tension to the workpiece on the workpiece stage.

In the recording device, the supply/recovery unit preferably further includes a delivery device having a delivery reel configured and arranged to deliver the workpiece, and a delivery-side buffer mechanism configured and arranged to buffer, with respect to the workpiece stage, the workpiece delivered from the delivery reel.

According to the aspect described above, the workpiece having been fed to the upstream end in the feed direction can be absorbed by the delivery-side buffer mechanism, and therefore it is unnecessary for the workpiece, once delivered, to be again wound up onto the delivery reel.

This configuration is particularly effective when the workpiece stage is again returned to the upstream end after having been fed to the downstream end in the feed direction for the purpose of a recording operation, and another recording operation is carried out on a single recording region.

BRIEF DESCRIPTION OF THE DRAWINGS

Referring now to the attached drawings which form a part of this original disclosure.

DETAILED DESCRIPTION OF EXEMPLARY EMBODIMENTS

The recording device according to a first embodiment of the present invention is described below with reference made to the accompanying drawings. This recording device is one in which, for example, an ultraviolet curing ink (UV ink) is ejected from an inkjet head onto a workpiece of thin film form which is advanced and retracted by a so-called reel-to-reel system in order to print desired images or the like thereon. In the following description, the workpiece feed direction shall be designated as the X-axis direction, a direction orthogonal to the X-axis direction as the Y-axis direction, a direction orthogonal to both the X-axis direction and the Y-axis direction as the Z-axis direction, and rotation direction within a plane parallel to the workpiece as the θ direction.

Figure 1A:
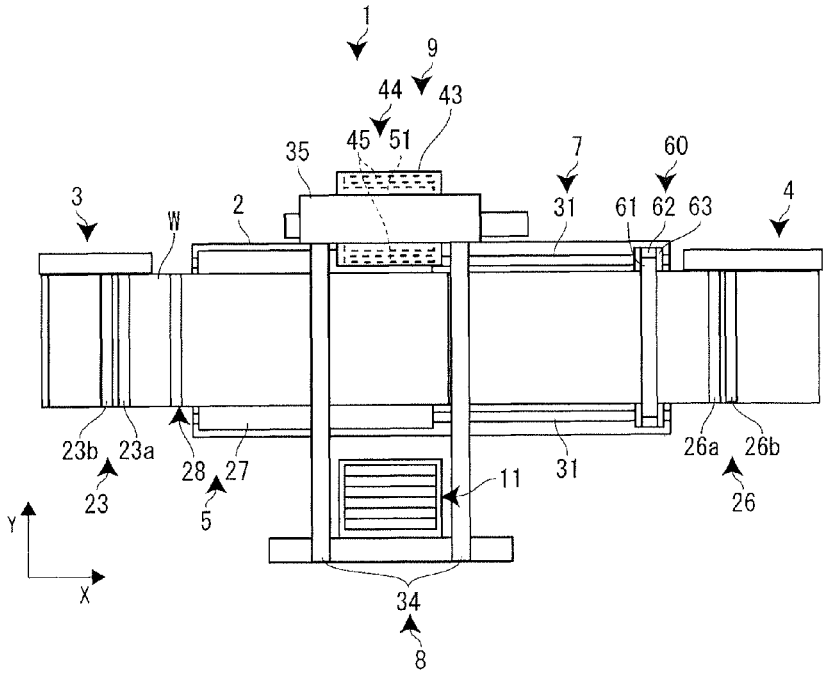
FIG. 1A is a plan view and FIG. 1B is a side view of an inkjet recording device.
Figure 1B:
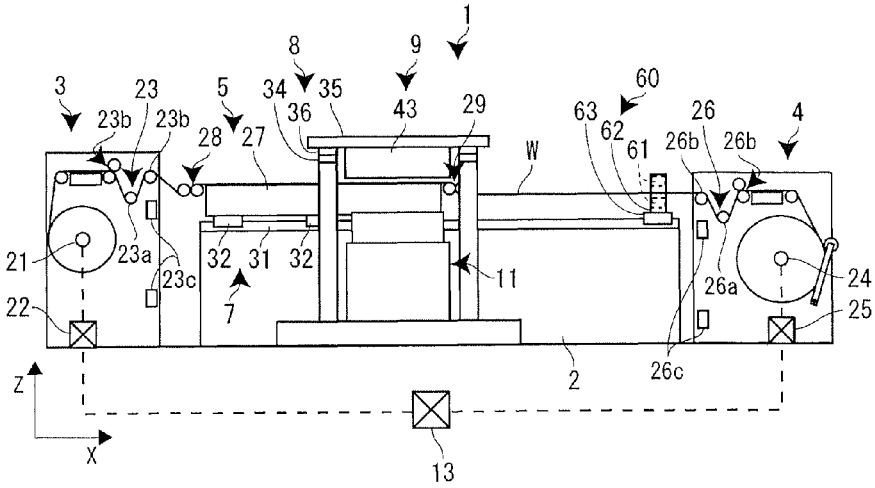

As shown in FIGS. 1A and 1B, the recording device 1 has a machine platform 2; a delivery device 3 for delivering an elongated workpiece W wound into roll form; a wind-up device 4 for winding up the printed workpiece W; a workpiece stage 5 arranged on the machine platform 2 and adapted for applying suction to an incoming workpiece W set thereon; a stage rotation mechanism (not shown) for rotating the workpiece stage 5 in the θ direction; an X-axis table 7 for intermittent feed of the workpiece W in the X-axis direction via the workpiece stage 5; a Y-axis table 8 suspended in the Y-axis direction so as to straddle the X-axis table 7; a carriage unit 9 having a plurality of inkjet heads 51 for ejecting ink to carry out printing of the workpiece W and installed in a traveling fashion on the Y-axis table 8; and workpiece-holding unit 60 provided at the downstream end in the X-axis direction of the workpiece stage 5, for clamping and anchoring the workpiece W.

The recording device 1 is provided with a maintenance device 11 which is composed of a suction unit for forcibly discharging ink from the inkjet heads 51, and a wiping unit for wiping the nozzle face 57; and a control device 13 for overall control of the recording device 1. The maintenance device 11 is disposed in a maintenance region situated away in the Y-axis direction from the printing region where the X-axis table 7 and the Y-axis table 8 intersect, and is adapted to carry out maintenance of the inkjet heads 51 positioned facing towards the maintenance region.

In this recording device 1, once suction is applied by the workpiece stage 5 to the workpiece W that has been delivered from the delivery device 3, the workpiece W is intermittently advanced in the X-axis direction (sub-scanning) by the X-axis table 7 through the agency of the workpiece stage 5, while printing of a printing region of the suction-held workpiece W is carried out by ejecting ink thereon from the inkjet heads 51 in tandem with reciprocating movement (main scanning) of the carriage unit 9.

The delivery device 3 is arranged to the upstream end of the workpiece W feed direction (X-axis direction) from the machine platform 2. The delivery device 3 is provided with a delivery reel 21 onto which the workpiece W has been wound in a roll; a delivery motor 22 for causing the delivery reel 21 to rotate for delivery; and a delivery-side buffer mechanism 23 adapted to inflect the delivered workpiece W to a V shaped path in the Z-axis direction, and impart low tension to the workpiece W.

As shown in FIG. 1B, the delivery-side buffer mechanism 23 has a delivery end dancer roller 23*a* capable of travel in the Z-axis direction so as to impart constant back tension to the workpiece W; delivery end guide rollers 23*b* separately provided at the upstream end and the downstream end of the delivery end dancer roller 23*a*; and a pair of upper and lower delivery end sensors 23*c* for detecting the position of the delivery end dancer roller 23*a* in the Z-axis direction. The delivery end guide roller 23*b* at the upstream end constitutes a nip roller.

Figure 4:
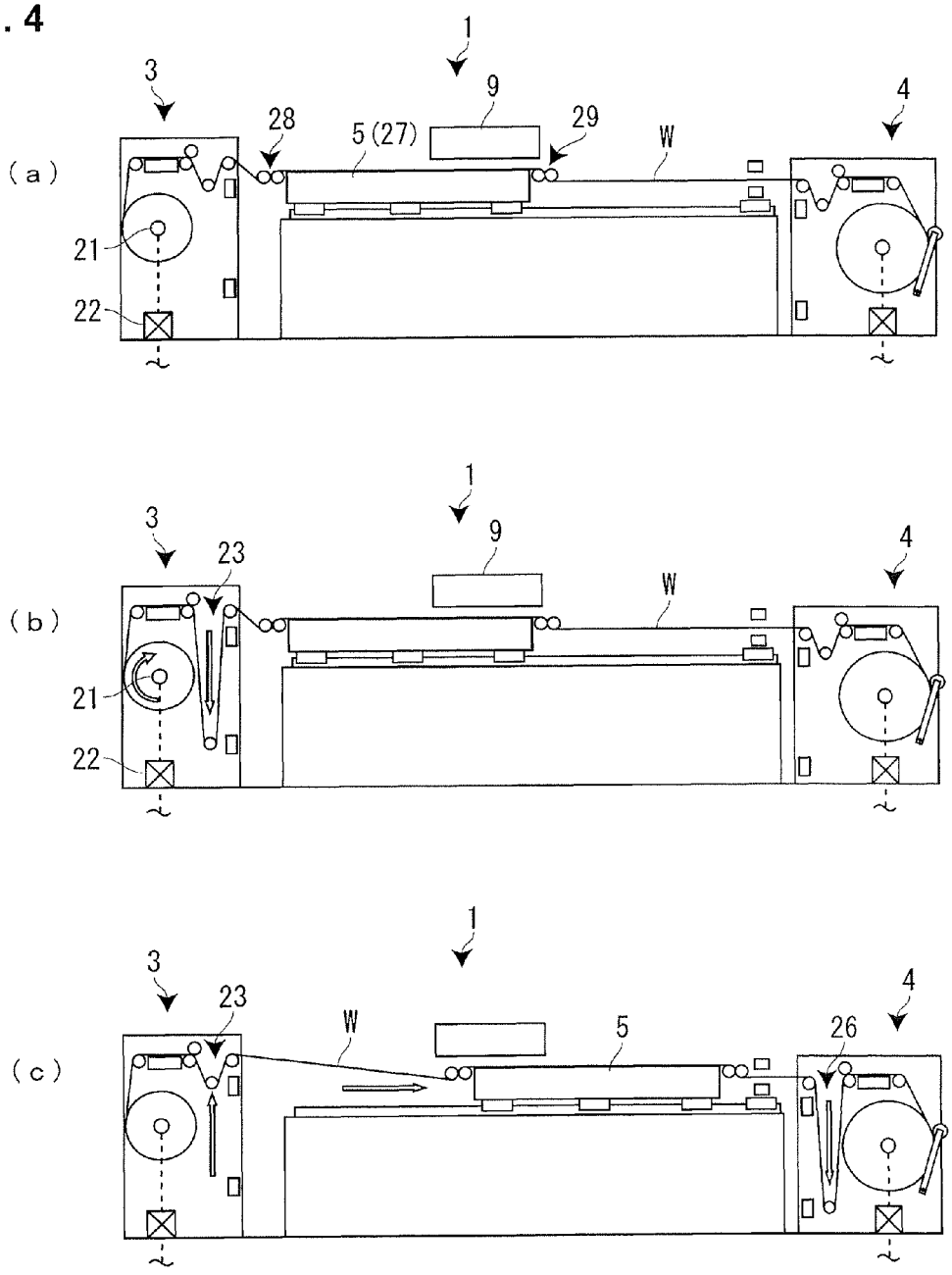
FIG. 4 is an illustration (1) illustrating the workpiece-advancing/retracting method according to the first embodiment.

The length of the workpiece W kept by the delivery-side buffer mechanism 23 is set to a length equal to or greater than the travel distance of the workpiece stage 5 (see FIG. 4 (*b*)). In the present embodiment, in order to be able to maintain this length of the workpiece W, the delivery motor 22 is driven through detection by the delivery end sensor 23*c* on the upper limit end, whereas the delivery motor 22 is stopped through detection by the delivery end sensor 23*c* on the lower limit end. In so doing, it is possible to deliver the necessary amount of the workpiece W. As will be described in detail later, the need to rewind the workpiece W onto the delivery reel 21 when carrying out recording operations multiple times on a single recording region can be eliminated through absorption of the workpiece W by the delivery-side buffer mechanism 23.

The wind-up device 4 is arranged at the downstream end of the workpiece W feed direction (X-axis direction) from the machine platform 2. The wind-up device 4 is provided with a wind-up reel 24 for winding up the workpiece W into roll form; a wind-up motor 25 for rotating the wind-up reel 24 for performing a winding-up action; and a wind-up-side buffer mechanism 26 adapted to inflect the wound-up workpiece W to a V-shaped path in the Z-axis direction, and impart low tension to the workpiece W.

As shown in FIG. 1B, the wind-up-side buffer mechanism 26 has a wind-up end dancer roller 26*a* capable of travel in the Z-axis direction so as to impart constant forward tension to the workpiece W; wind-up end guide rollers 26*b* respectively provided at the upstream end and the downstream end of the wind-up end dancer roller 26*a*; and a pair of upper and lower wind-up end sensors 26*c* for detecting the position of the wind-up end dancer roller 26*a* in the Z-axis direction. The delivery end guide roller 23*b* at the downstream end constitutes a nip roller.

Like the delivery-side buffer mechanism 23, the wind-up-side buffer mechanism 26 is designed such that, in order to be able to maintain a prescribed length of the workpiece W, the wind-up motor 25 is driven through detection by the wind-up end sensor 26*c* on the lower limit end, whereas the wind-up motor 25 is stopped through detection by the wind-up end sensor 26*c* on the upper limit end. In so doing, it is possible to wind up the necessary amount of the workpiece W, in a manner unaffected by the roll diameter of the wind-up reel 24. Because of this, the workpiece W that has been fed toward the downstream end can be absorbed by the wind-up-side buffer mechanism 26, and therefore advancing/retracting can be carried out without the fed workpiece W being wound onto the wind-up reel 24.

The workpiece stage 5 contains a plurality of holes (not shown) formed on the surface, and has a stage body 27 adapted to suction the workpiece W which has been fed thereonto from the delivery device 3; infeed rollers 28 added in the upstream end section of the stage body 27 in the workpiece W conveyance (X-axis direction); and outfeed rollers 29 added in the downstream end section of the stage body 27 in the workpiece W conveyance (X-axis direction). The plurality of holes formed in the stage body 27 communicate respectively with vacuum suction equipment and compressed air supply equipment (not shown), though this arrangement is not described here in detail.

In a state with the workpiece W suctioned onto the stage body 27, the workpiece stage 5 is intermittently fed in the X-axis direction (from the upstream end to the downstream end) by the X-axis table 7. In the present embodiment, because drawing takes place multiple times in a single recording region, upon reaching a downstream edge position at which drawing of the equivalent of a single recording region terminates (printing termination position), the stage is returned to the upstream edge position (printing start position) by the X-axis table 7.

The infeed rollers 28 and the outfeed rollers 29 are respectively composed of freely rotating nip rollers, and are disposed lined up in the X-axis direction. The infeed rollers 28 and the outfeed rollers 29 are provided in rising/lowering fashion between a lowered position, which is a position in which the respective upper parts thereof are approximately coplanar with the upper face of the stage body 27, and a raised position that is slightly (about several millimeters) elevated above the lowered position. In preferred practice, the raising/lowering mechanism for the infeed rollers 28 and the outfeed rollers 29 is composed of a cylinder (either pneumatic or hydraulic), a motor and rack-and-pinion, or the like.

The workpiece W crosses over the upper face of the stage body 28 in a state of being nipped by the infeed rollers 28 and the outfeed rollers 29. Through travel of the infeed rollers 28 and the outfeed rollers 29 to the lowered position, it is possible for the workpiece W (recording region) to be held by suction onto the upper face of the stage body 27, whereas, when the holding by suction is released (vacuum suction is halted) and compressed air is supplied between the workpiece W and the stage body 27, the workpiece W is caused to float slightly through travel to the raised position. In so doing, the workpiece W can be advanced to or retracted from the upper face of the stage body 27 without unnecessary tension being imparted thereto. Moreover, because the recording region is separated from (floats above) the workpiece stage 5, advancing/retracting can take place without striating or otherwise damaging the workpiece W.

When at the lowered position, the infeed rollers 28 and the outfeed rollers 29 line up in the X-axis direction, and are approximately coplanar with the upper face of the stage body 27. Because of this, flatness of the workpiece W can be maintained not just in the region of holding by suction thereof on the stage body 27, but all the way between the position where nipped by the infeed rollers 28 and the position where nipped by the outfeed rollers 29. In other words, a wide recording region can be ensured. In preferred practice, when the infeed rollers 28 and the outfeed rollers 29 are raised or lowered, one among the infeed rollers 28 and the outfeed rollers 29 will start to rise or fall following a delay once the other has risen or fallen. In so doing, during travel to the lowered position, air can be pushed out from between the workpiece W and the stage body 27 so that the workpiece W can come into intimate contact with the stage body 27 and good holding by suction can be secured.

The X-axis table 7 has a pair of X-axis guide rails 31 arranged on the machine platform 2 and extending in the X-axis direction, and a motor-driven X-axis slider 32 for slidably supporting the workpiece stage 5 along the X-axis guide rails 31. The X-axis table 7 stops during outbound movement (or return movement) of the carriage unit 9 (the inkjet heads 51); and before the next outbound movement (or return movement) feeds the workpiece W by the equivalent of the printing width towards the downstream end in the X-axis direction. In other words, after the carriage unit 9 has completed a printing scan, the X-axis table 7 intermittently feeds (line feeds) the workpiece stage 5 (the workpiece W) by a distance corresponding to the printed width thereof. The driving system thereof is preferably composed of a linear motor, a motor and a ball-screw mechanism, or the like.

The Y-axis table 8 has a pair of Y-axis guide rails 34 which are suspended so as to straddle the machine platform 2 in the Y-axis direction, a bridge plate 35 from which the carriage unit 9 is hung, and a motor-driven Y-axis slider 36 for slidably supporting the bridge plate 35 in the Y-axis direction. The Y-axis table 8 reciprocates the inkjet heads 51 in the Y-axis direction during printing through the agency of the carriage unit 9, as well as positioning the inkjet heads 51 to face the maintenance device 11. The driving system thereof is preferably composed of a linear motor, a motor and a ball-screw mechanism, a belt and pulley mechanism, or the like.

The carriage unit 9 is provided with a carriage body 43 suspended from the bridge plate 35, and with a head unit 44 suspended from the carriage body 43 and having a plurality of inkjet heads 51. The carriage body 43 incorporates a mechanism for θ rotation of the head unit 44. In the head unit 44, the plurality of inkjet heads 51 are installed on a head plate (not shown), and a pair of ultraviolet lamps 45 are installed at both edges in the Y-axis direction of the head plate.

Figure 2:
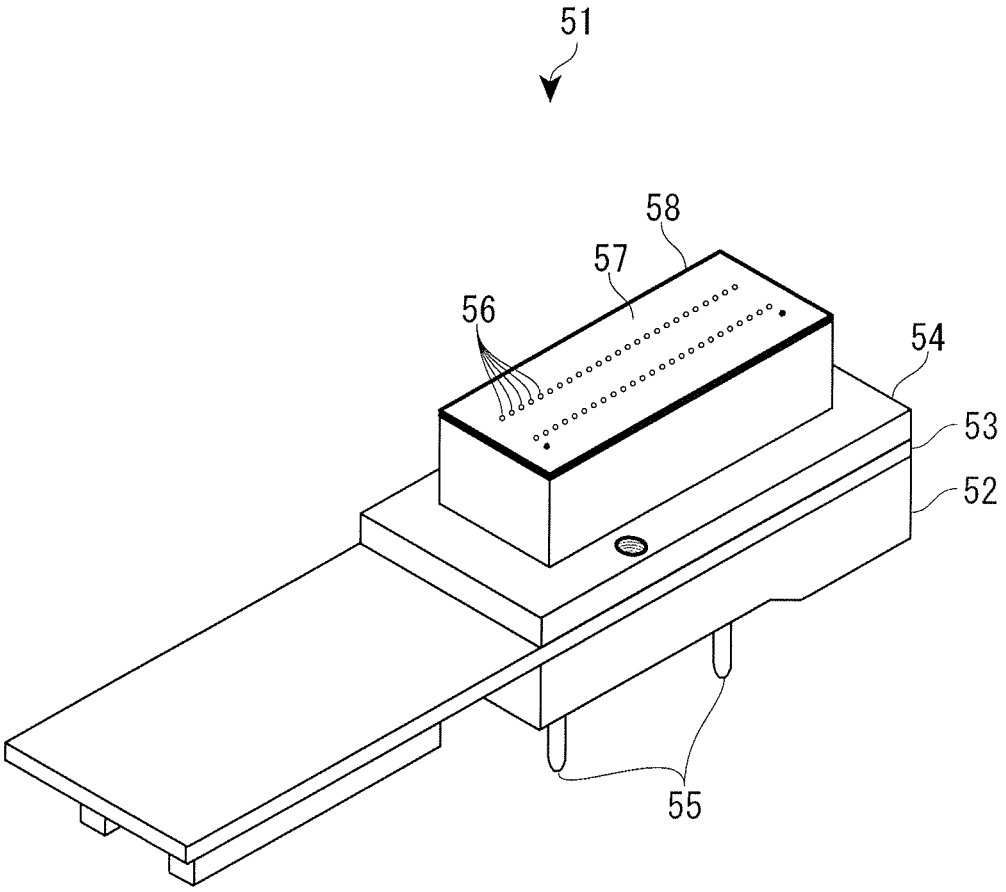
FIG. 2 is a perspective view of an inkjet head.
Figure 3:
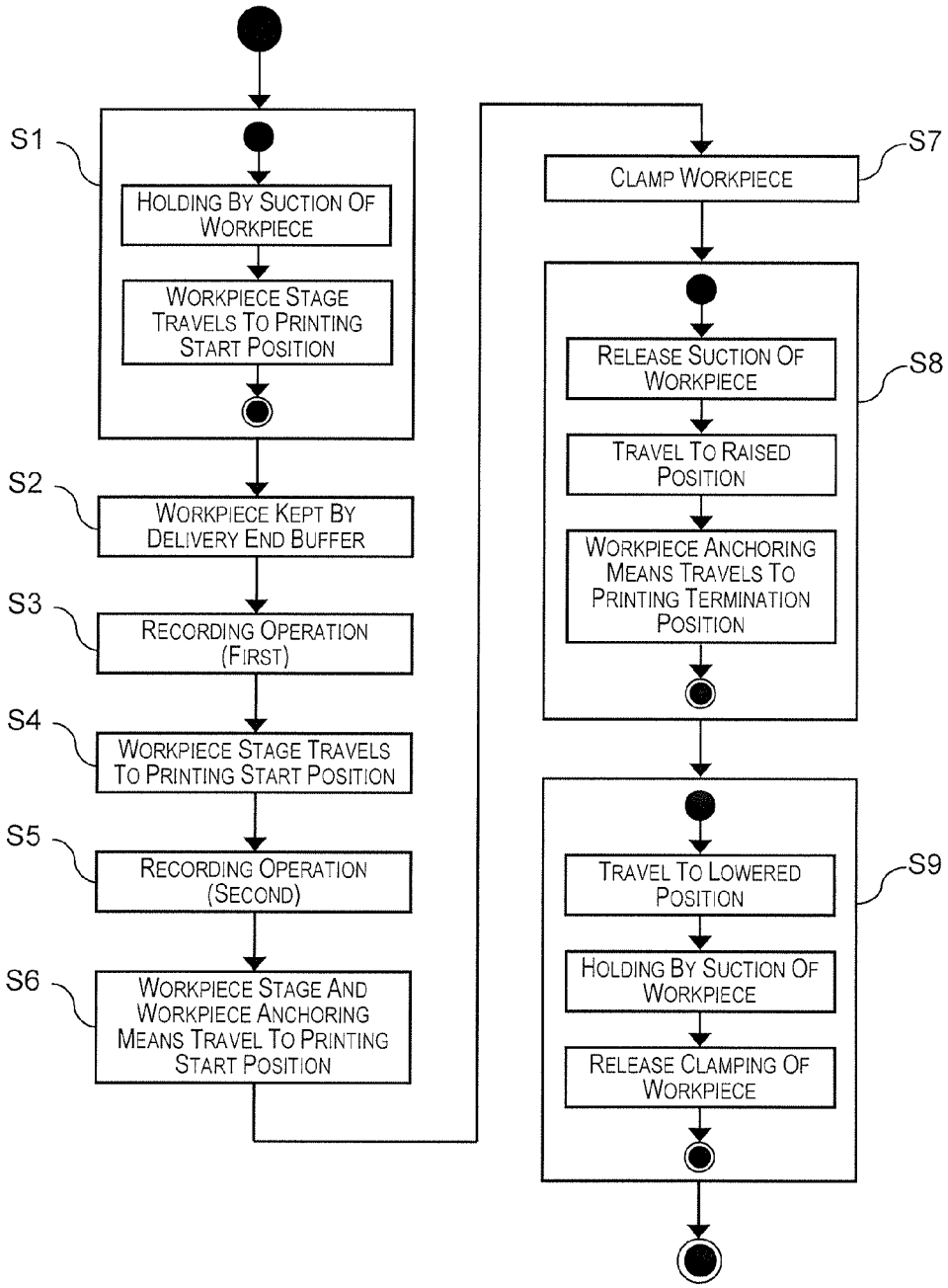
FIG. 3 is a flowchart of a workpiece-advancing/retracting method according to a first embodiment.

As shown in FIG. 2, the inkjet heads 51 are of a so-called "dual design," provided with an ink-introducing section 52 having dual connector needles 55; a dual head board 53 leading from the ink-introducing section 52; a head body 54 leading downward from the ink-introducing section 52 and having formed in the interior thereof a head internal flow passage filled with ink; and a nozzle plate 58 having a nozzle face 57 onto which open a multitude of ejection nozzles 56. In the head body 54, there are configured piezoelectric elements corresponding to each of the ejection nozzles 56, and when voltage is applied to the piezoelectric elements, ink drops are ejected from the ejection nozzles 56.

The ink used in the present invention is so-called ultraviolet curing ink, and when the pair of ultraviolet lamps 45 installed on the head unit 44 are illuminated, the ultraviolet curing ink deposited on the workpiece W securely cures thereon.

As shown in FIGS. 1A and 1B, the workpiece-holding unit 60 has a pair of clampers 61 respectively facing towards the upper face and the lower face of the workpiece W; a clamp-driving mechanism 62 for causing the pair of clampers 61 to travel closer together; and a motor-driven clamper/slider 63 for slidably supporting the clampers 61 and the clamp-driving mechanism 62 along the pair of X-axis guide rails 31 mentioned previously. The workpiece-holding unit 60 is disposed at a home position which is a position in proximity to the wind-up device 4 (the downstream end in the X-axis direction), and is adapted to travel at the downstream end in the X-axis direction of the workpiece stage 5. The "advancing/retracting unit" recited in the claims refers to the aforementioned X-axis table 7 and the clamper/slider 63.

The clampers 61 are formed to a larger width than the width of the workpiece W in the Y-axis direction, and are arranged facing both front and back faces of the workpiece W so as to traverse the workpiece W in the Y-axis direction. The pair of clampers 61 are composed, on the faces thereof facing the workpiece W, of elastic material such as rubber, and are designed to not give rise to relative slippage or to damage the workpiece W when the workpiece W is nipped from the vertical direction through driving of the clamp-driving mechanism 62.

The clamp-driving mechanism 62 is linked to the pair of clampers 61 at both end portions thereof, and causes the pair of clampers 61 to travel (inward-directed travel) so as to nip the workpiece W in the vertical direction, with the workpiece W at the center. Through inward-directed travel of the pair of clampers 61 in this way, unwanted tension can be prevented from being applied to the workpiece W on the conveyance path leading from the delivery device 3 to the wind-up device 4, doing so without travel of the workpiece W in the vertical direction. In so doing damage (including stretching) of the workpiece W, or error arising in the amount of travel during travel of the workpiece W while nipped by the workpiece-holding unit 60, can be prevented. The clamp-driving mechanism 62 is preferably composed of a cylinder (either pneumatic or hydraulic), a motor and rack-and-pinion, or the like.

By way of a drive system composed of a motor and belt mechanism, the clamper/slider 63 reciprocates the supported clampers 61 and the clamp-driving mechanism 62 in the X-axis direction. The workpiece-holding unit 60 is designed to feed the workpiece W to the wind-up device 4 by virtue of nipping the workpiece W with the pair of clampers 61 and causing the clamper/slider 63 to travel to the downstream end in the X-axis direction. This process is described in detail further below. The drive system of the clamper/slider 63 may be composed of a linear motor or a motor and ball screw mechanism, or alternatively a cylinder (either pneumatic or hydraulic) or the like.

Next, the workpiece W advancing/retracting method according to the embodiment carried out by the control device 13 is described with reference made to FIGS. 3 to 6. First, as shown in FIG. 4 (*a*), in Step S1, the roll-fed workpiece W is guided onto the delivery reel 21, and a delivered leading edge portion thereof is threaded through the infeed rollers 28 and the outfeed rollers 29, and connected to the wind-up reel 24. The infeed rollers 28 and the outfeed rollers 29 then travel to the lowered position, the recording region of the workpiece W is held by suction on the workpiece stage 5 (the stage body 27), and the workpiece stage 5 travels to the printing start position.

As shown in FIG. 4 (*b*), in Step S2, the delivery motor 22 is driven, a length of the workpiece W approximately equal to the travel distance of the workpiece stage 5 is delivered, and the delivered workpiece W is kept by the delivery-side buffer mechanism 23.

In Step S3, while the carriage unit 9 is scanned in the Y-axis direction across the recording region which is held by suction on the workpiece stage 5, ink drops are ejected from the inkjet heads 51 to carry out prescribed printing (print scanning). Subsequently, the workpiece stage 5 (the workpiece W) is fed to the downstream end in the X-axis direction by a distance corresponding to the printed width in the print scan (line feed). Print scanning and line feed are repeated multiple times to carry out printing equivalent to a single recording region (refers to the "recording operation" recited in the claims).

Once the recording operation equivalent to a single recording region has terminated, the workpiece stage 5 reaches the printing termination position (see FIG. 4 (*c*)). In Step S2, the workpiece W which was kept by the delivery-side buffer mechanism 23 is drawn out towards the downstream end in the X-axis direction in association with travel of the workpiece stage 5, and at the same time the workpiece W at the downstream end in the X-axis direction of the workpiece stage 5 is fed into the wind-up-side buffer mechanism 26 and is kept thereby. During execution of Step S3, the delivery motor 22 and the wind-up motor 25 are not driven.

Figure 5:
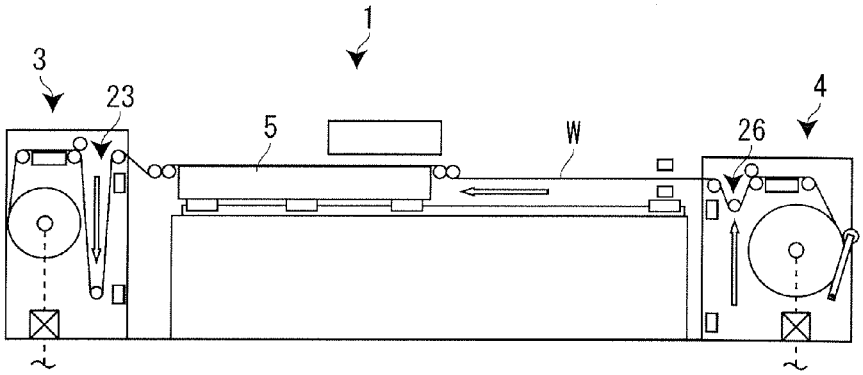
FIG. 5 is an illustration (2) illustrating the workpiece-advancing/retracting method according to the first embodiment.
Figure 5:
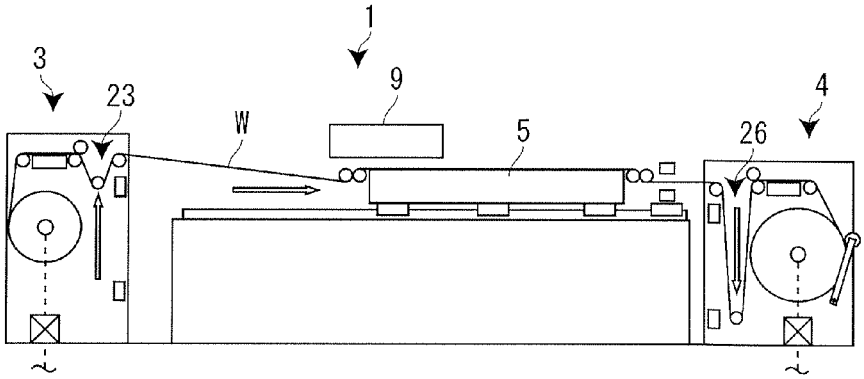
Figure 5:
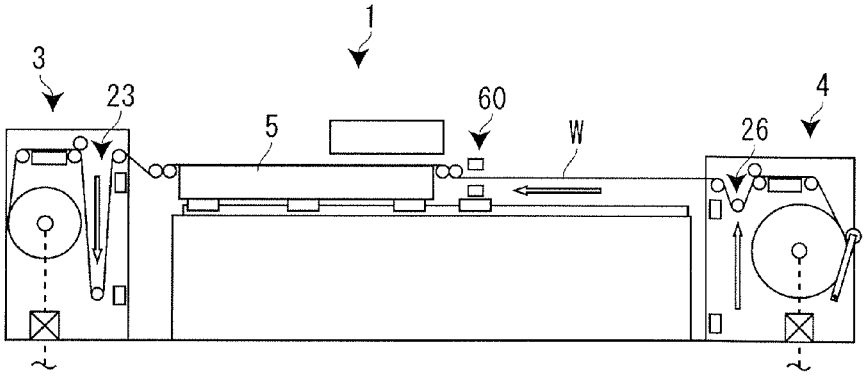

In Step S4, in order to carry out the second recording operation on the single recording region, the workpiece stage 5 facing the printing termination position is returned to the printing start position (see FIG. 5 (*d*)). Once so returned, the workpiece W which was kept by the wind-up-side buffer mechanism 26 in Step S3 is now drawn out towards the upstream end in the X-axis direction in association with travel of the workpiece stage 5, and at the same time the workpiece W at upstream end in the X-axis direction of the workpiece stage 5 is fed into the delivery-side buffer mechanism 23 and is again kept thereby. In this way, the workpiece W which was fed to the upstream end can be absorbed by the delivery-side buffer mechanism 23, and it is therefore unnecessary to again wind up the workpiece W onto the delivery reel 21. This sort of configuration is particularly effective in cases where recording operations are carried out multiple times, as in the present embodiment. In the present embodiment, recording operations are carried out twice on a single recording region, but the number of recording operations could be one, or two or more.

In Step S5, a second recording operation is carried out on the recording region for which the first recording operation has terminated (see FIG. 5 (*e*)). Because Step S5 is analogous to Step S3 described previously, a description is omitted here.

In Step S6, the second recording operation terminates, and the recording region which faces the printing termination position is again returned to the printing start position. During return travel, the workpiece-holding unit 60 also travels to the printing start position (see FIG. 5 (*f*)). In other words, the workpiece-holding unit 60 is now positioned in proximity to the downstream end of the outfeed rollers 29 of the workpiece stage 5 which has traveled to the printing start position.

Figure 6:
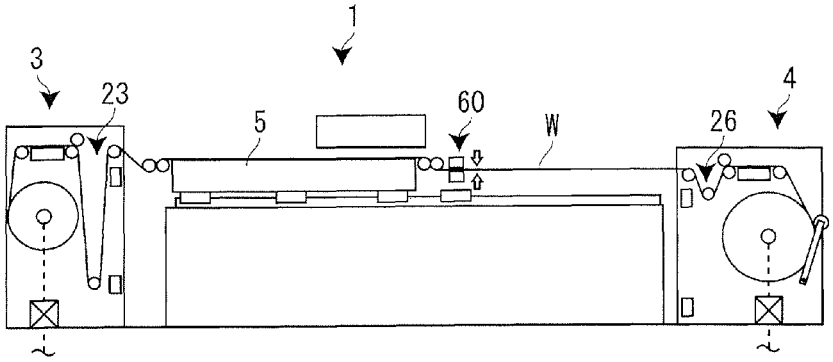
FIG. 6 is an illustration (3) illustrating the workpiece-advancing/retracting method according to the first embodiment.
Figure 6:
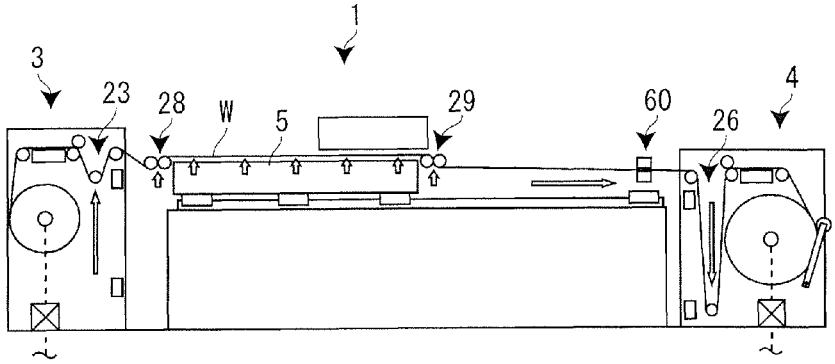
Figure 6:
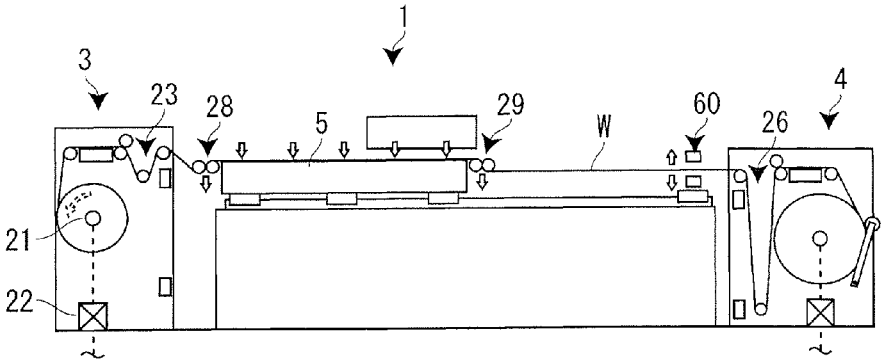

As shown in FIG. 6 (*g*), in Step S7, the workpiece-holding unit 60 is driven so as to nip and clamp the workpiece W (refers to the "holding operation" recited in the claims).

As shown in FIG. 6 (*h*), in Step S8, suction of the workpiece W (recording region) on the workpiece stage 5 is released (vacuum suction is halted) and compressed air is supplied (refers to the "suction-releasing operation" recited in the claims); then the infeed rollers 28 and the outfeed rollers 29 travel to the raised position (refers to the "separation operation" recited in the claims). Subsequently, the workpiece stage 5 is immobilized, and the workpiece-holding unit 60 travels downstream (refers to the "advancing/retracting operation" recited in the claims).

During this time, the workpiece W (recording region) which has finished printing on the workpiece stage 5 is drawn out to the downstream end in the X-axis direction, and in association therewith, a length of the workpiece W equivalent to the drawn-out portion is absorbed (kept) by the wind-up-side buffer mechanism 26. Meanwhile, the length of the workpiece W that was kept by the delivery-side buffer mechanism 23 is now drawn out to face onto the workpiece stage 5.

As shown in FIG. 6 (*i*), in Step S9, after the infeed rollers 28 and the outfeed rollers 29 have traveled to the lowered position, and an unrecorded recording region facing onto the workpiece stage 5 has been held by suction, the workpiece W is released from the clamped state by the workpiece-holding unit 60. In the present embodiment, immediately before or immediately after suctioning of the workpiece W on the workpiece stage 5, the delivery motor 22 is driven in the windup direction to adjust the tension acting on the workpiece W on the workpiece stage 5.

The control device 13 then drives the wind-up motor 25 and winds up the workpiece W that was kept by the wind-up-side buffer mechanism 26, and in the same way as shown in Step S2 described previously, drives the delivery motor 22 to deliver a length of the workpiece W approximately equal to the travel distance of the workpiece stage 5 to the delivery-side buffer mechanism 23 (see FIG. 4 (*b*)). In so doing, it is possible to print a new recording region.

The "recording step" recited in the claims refers to Step S3 and Step S5, and the "holding step" refers to Step S7. The "advancing/retracting" step recited in the claims refers to travel of the workpiece-holding unit 60 in Step S8.

According to the configuration above, through relative travel of the workpiece-holding unit 60 and the workpiece stage 5 in a state in which part of the workpiece W is held by the workpiece-holding unit 60, advancing/retracting of the workpiece W (recording region) on the workpiece stage 5 is carried out simultaneously. In other words, through relative travel in a state with part of the workpiece W held, no slippage whatsoever is produced between the workpiece W and the workpiece-holding unit 60. That is, the workpiece W can be reliably caused to travel for the travel distance necessary for advance or retract. In so doing, retracting of the recording region that has finished being recorded and advancing of an unrecorded recording region with respect to the workpiece stage 5 can be carried out reliably and with good accuracy.

Moreover, because the accuracy of advancing/retracting (feeding) of the workpiece W can be assured by the accuracy of travel of the workpiece-holding unit 60, a high level of feed accuracy can be readily ensured, and accuracy may be improved, particularly as compared with the level of feed accuracy attained with rollers and an encoder or the like. Accuracy is also readily improved.

Second Embodiment

Figure 7:
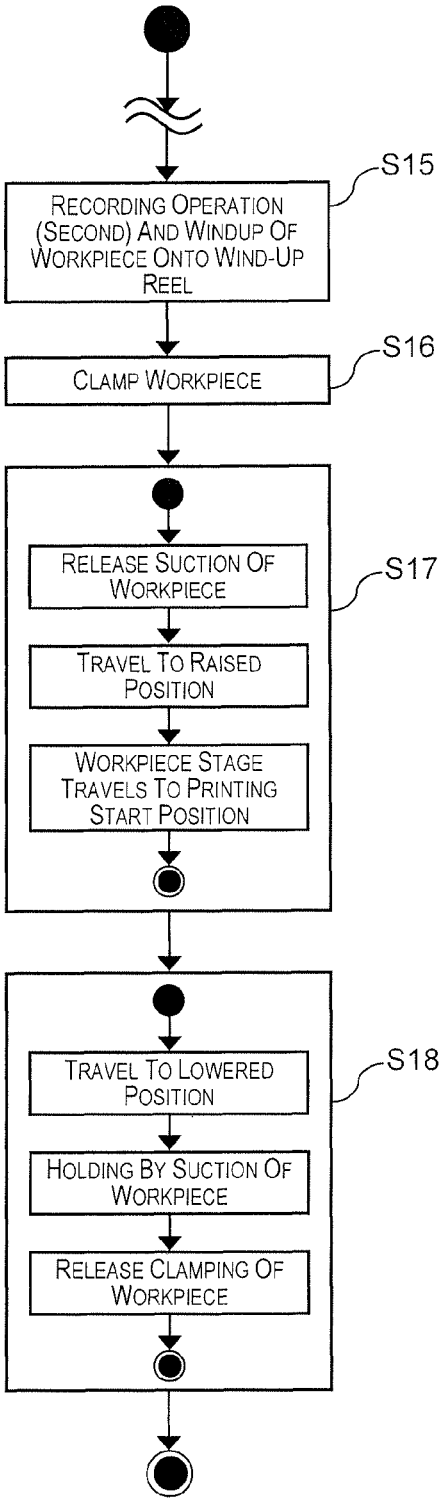
FIG. 7 is a flowchart of a workpiece-advancing/retracting method according to a second embodiment.

A recording device 1 and a workpiece-advancing/retracting method according to a second embodiment are described with reference to FIG. 7 and FIG. 8.

In the recording device 1 according to the second embodiment, the workpiece-holding unit 60 is fixedly arranged. In other words, the clamper-slider 63 of the workpiece-holding unit 60 is eliminated, and instead the workpiece-holding unit 60 is fixedly disposed on the X-axis guide rail 31 or the wind-up device 4. Other arrangements of the recording device 1 are comparable to those of the first embodiment and are not described.

The workpiece-advancing/retracting method according to the second embodiment is comparable to that in the first embodiment from Step S1 to Step S4 (FIG. 4 (*a*) to (*c*), FIG. 5 (*d*)), but differs therefrom starting with Step S5 (here, denoted as Step S15). In the following description, descriptions of arrangements comparable to those in the first embodiment are omitted, and only the points of difference are shown.

In Step S15, as in Step S5 in the first embodiment, a second recording operation is carried out on a recording region for which the first recording operation has terminated. During this time, in synchronization with line feed in the recording operation, the wind-up motor 25 is driven, and the workpiece W is wound up onto the wind-up reel 24 (see. FIG. 8 (*a*)). In so doing, because the workpiece W is not absorbed by the wind-up-side buffer mechanism 26, the step of winding up the length of workpiece W that was kept by the wind-up-side buffer mechanism 26 after the recording operation has terminated can be omitted. Driving of the wind-up motor 25 is controlled based on detection results by the wind-up end sensors 26*c*. In other words, it is sufficient for drive control of the wind-up motor 25 to be carried out such that the workpiece W is kept between the upper limit and the lower limit of the wind-up end sensors 26*c*.

Figure 8:
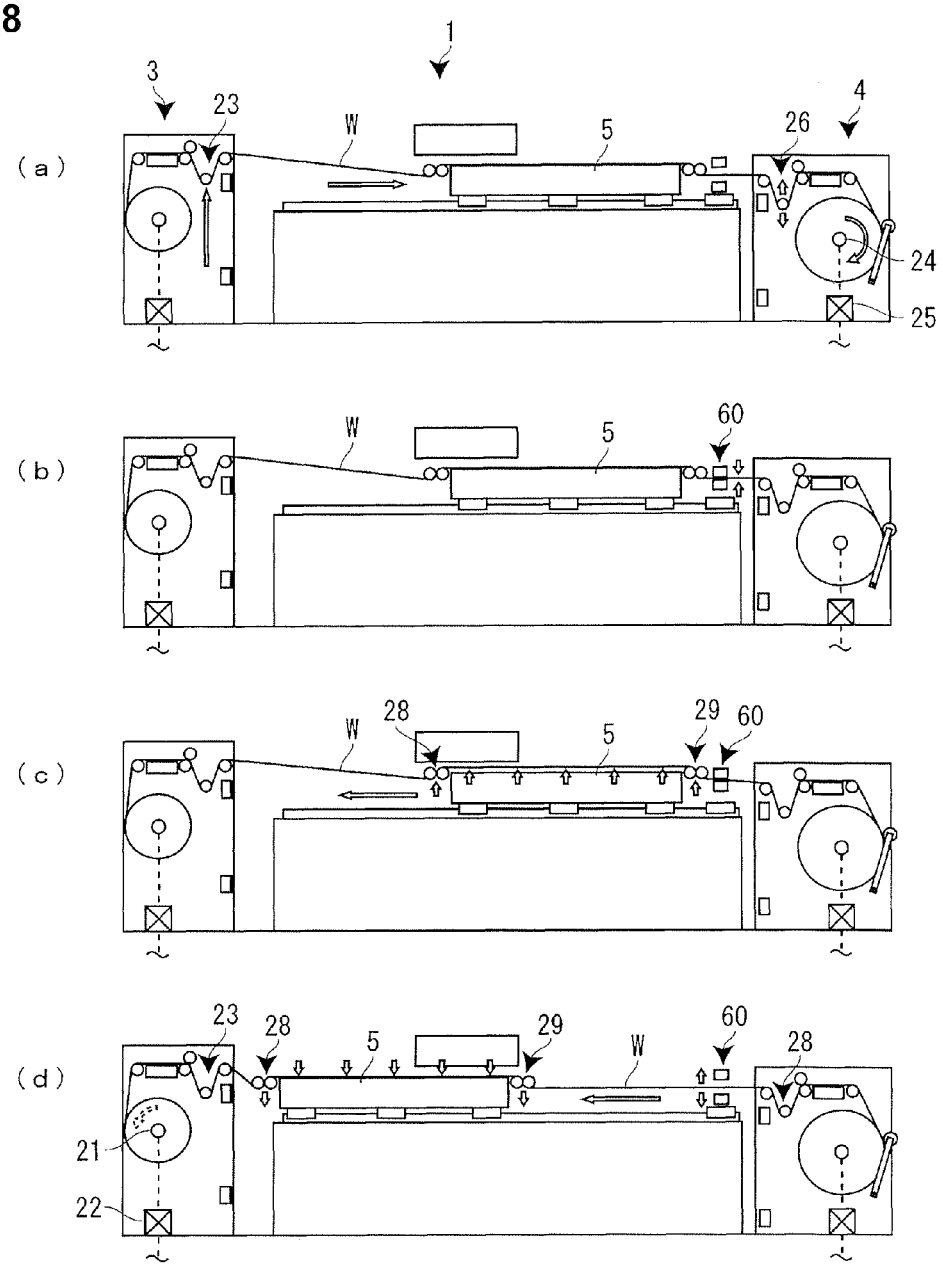
FIG. 8 is an illustration illustrating the workpiece-advancing/retracting method according to the second embodiment.

As shown in FIG. 8 (*b*), in Step S16, in a state with the workpiece stage 5 having reached the printing termination position, the workpiece-holding unit 60 is driven so as to nip and clamp the workpiece W (holding operation).

As shown in FIG. 8 (*c*), in Step S17, suction of the recording region on the workpiece stage 5 is released and compressed air is supplied (suction-releasing operation), and the infeed rollers 28 and the outfeed rollers 29 travel to the raised position (separation operation). Subsequently, the workpiece stage 5 travels towards upstream (advancing/retracting operation). Thereupon, because the workpiece W which has been held and secured by the fixedly disposed workpiece-holding unit 60 is immobile whereas the workpiece stage 5 travels, the workpiece stage 5 now faces an unprinted recording region (see FIG. 8 (*d*)).

As shown in FIG. 8 (*d*), in Step S18, the infeed rollers 28 and the outfeed rollers 29 travel to the lowered position, and a new recording region facing onto the workpiece stage 5 is held by suction. During this time, as in Step S9 in the first embodiment, the tension acting on the workpiece W on the workpiece stage 5 is adjusted by the delivery motor 22. After the workpiece W is held by suction, the workpiece W is released from the state of being clamped by the workpiece-holding unit 60. Subsequently, the process again returns to Step S2 (that of the first embodiment), whereupon printing of the new recording region is possible.

In the workpiece-advancing/retracting method according to the second embodiment, because there is no travel of the workpiece-holding unit 60, the clamper-slider 63 of the workpiece-holding unit 60 is eliminated; however, optionally, the recording device 1 according to the first embodiment (one in which the workpiece-holding unit 60 is slidable in the X-axis direction) may be used with the workpiece-advancing/retracting method according to the second embodiment.

Through the configuration described above, accuracy of advancing/retracting (feeding) of the workpiece W can be assured by the accuracy of travel of the workpiece stage 5, thus affording effects comparable to the first embodiment.

Third Embodiment

Figure 9:
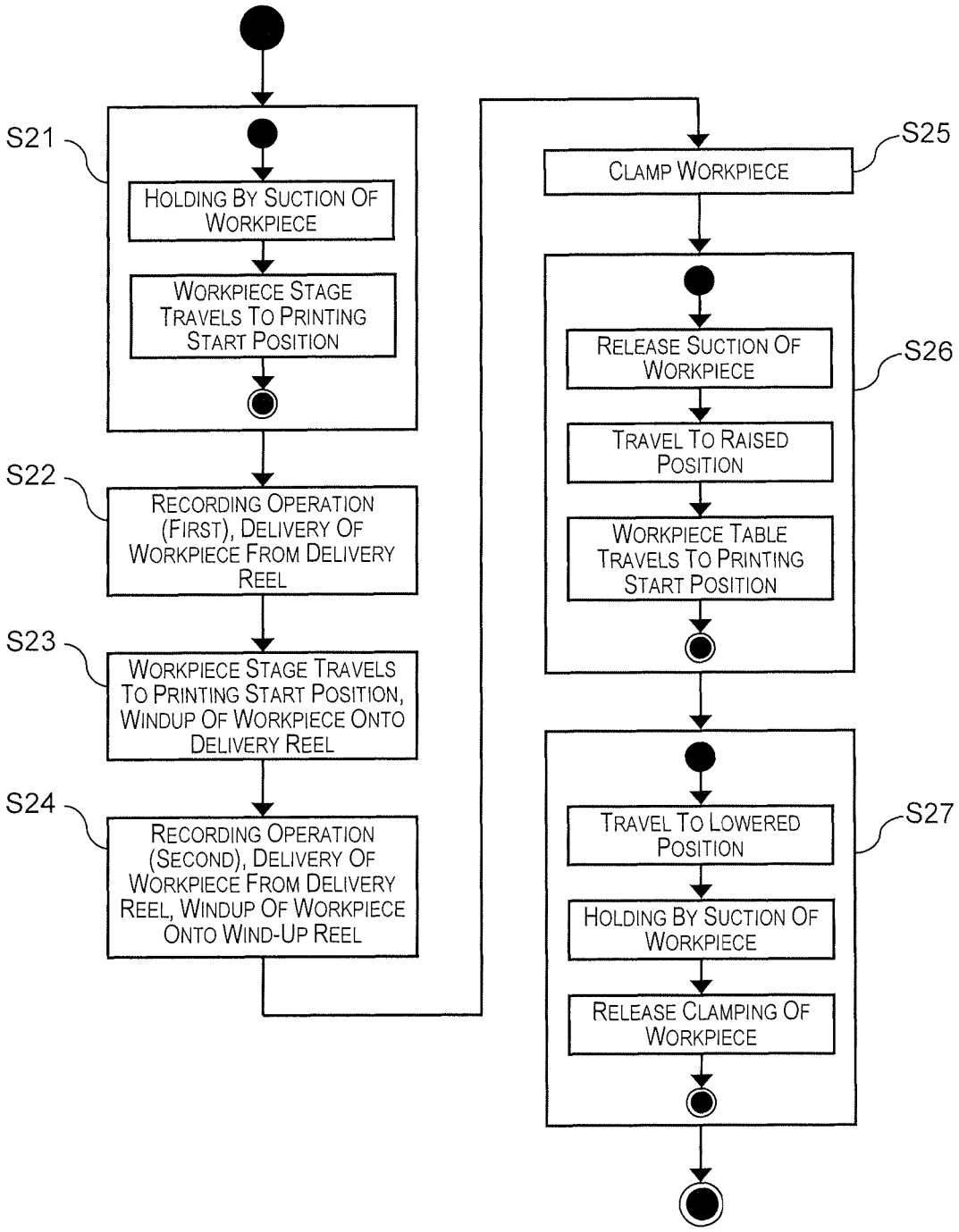
FIG. 9 is a flowchart of a workpiece-advancing/retracting method according to a third embodiment.

A recording device 1 and a workpiece-advancing/retracting method according to a third embodiment are described with reference to FIGS. 9 to 11.

The recording device 1 according to the third embodiment, like that according to the second embodiment, has workpiece-holding unit 60 lacking the clamper-slider 63, and fixedly arranged on the wind-up device 4.

Also, the recording device 1 according to the third embodiment lacks the delivery-side buffer mechanism 23 in the delivery device 3. Other arrangements of the recording device 1 are comparable to those of the first embodiment and are not described. Optionally, the workpiece-holding unit 60 may be arranged on the X-axis guide rail 31.

The workpiece-advancing/retracting method according to the third embodiment lacks Step S2 described in the first embodiment. In the following description, only points of difference from the first embodiment and the second embodiment are given.

Figure 10:
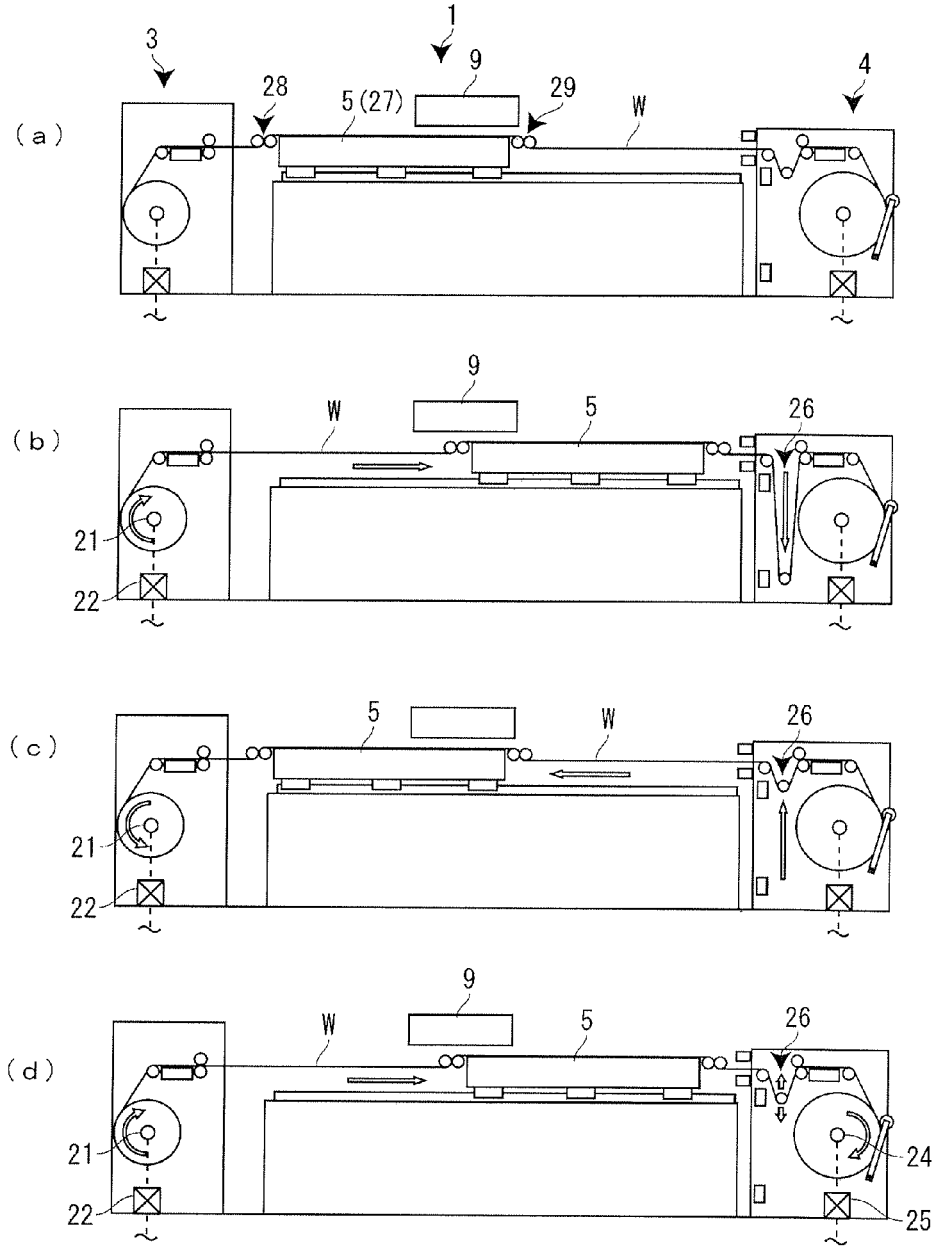
FIG. 10 is an illustration (1) illustrating the workpiece-advancing/retracting method according to the third embodiment.

First, in Step S21, as in Step S1 in the first embodiment, a recording region of the workpiece W is held by suction onto the workpiece stage 5 (stage body 27), and the workpiece stage 5 travels to the print start position (see FIG. 10 (*a*)).

In Step S22, as in Step S3 in the first embodiment, a recording operation is carried out on the recording region which is held by suction on the workpiece stage 5. During this time, in synchronization with line feed in the recording operation, the delivery motor 22 is driven, and delivery of the workpiece W starts (see FIG. 10 (*b*)). Once printing of the equivalent of a single recording region terminates, the workpiece stage 5 reaches the printing termination position. A delivered length of the workpiece W equivalent to the travel distance of the workpiece stage 5 is fed to the wind-up-side buffer mechanism 26 where it is kept. During execution of Step S3, the wind-up motor 25 is not driven, and rotation of the wind-up end guide rollers 26*b* on the downstream end is not permitted.

In Step S23, as in Step S4 in the first embodiment, the workpiece stage 5 which is facing the printing termination position now returns to the printing start position. During this time, simultaneously with the start of return travel of the workpiece stage 5, the delivery motor 22 is driven, and windup of the delivered workpiece W onto the delivery reel 21 starts (see FIG. 10 (*c*)). Because of this, in Step S22, the workpiece W kept by the wind-up-side buffer mechanism 26 is drawn out towards the upstream end in the X-axis direction in association with travel of the workpiece stage 5, and the workpiece W on the upstream end of the workpiece stage 5 proceeds to be wound up onto the delivery reel 21.

In Step S24, the second printing operation is carried out by a procedure comparable to that of Step S22, and during this time, the delivery motor 22 is driven in synchronization with line feed in the recording operation, and simultaneously with (or after a delay from) the start of delivery of the workpiece W, the wind-up motor 25 is driven, and the workpiece W starts being wound up onto the wind-up reel 24 (see FIG. 10 (*d*)). In so doing, because the workpiece W is not absorbed by the wind-up-side buffer mechanism 26, the step of winding up the workpiece W after termination of the recording operation can be omitted. Driving of the wind-up motor 25 is controlled based on detection results by the wind-up end sensors 26*c*.

Figure 11:
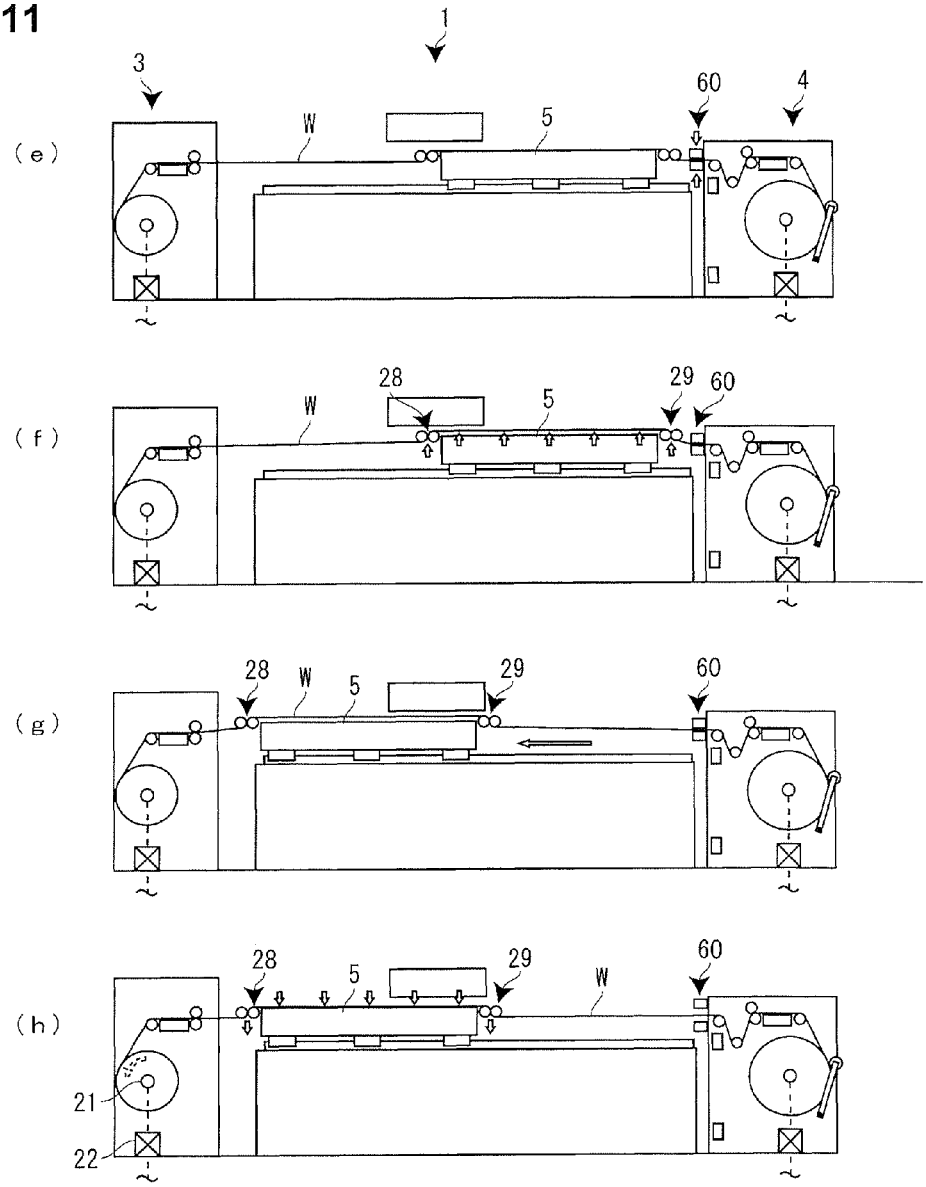
FIG. 11 is an illustration (2) illustrating the workpiece-advancing/retracting method according to the third embodiment.

The subsequent procedure is generally identical to Steps S16, S17, and S18 in the second embodiment: in Step S25, the workpiece-holding unit 60 is driven so as to nip and clamp the workpiece W (holding operation (see FIG. 11 (*e*)); and in Step S26, suction of the recording region on the workpiece stage 5 is released (suction-releasing operation), whereupon the infeed rollers 28 and the outfeed rollers 29 travel to the raised position (separation operation (see FIG. 11 (*f*)). Then, the workpiece stage 5 travels to the printing start position (advancing/retracting operation (see FIG. 11 (*g*)). Continuing on to Step S27, as shown in FIG. 11 (*h*), the infeed rollers 28 and the outfeed rollers 29 travel to the lowered position, and while imparting appropriate tension to the workpiece W, a new recording region is held by suction on the workpiece stage 5. Subsequently, the workpiece W is released from the state of being clamped by the workpiece-holding unit 60. Subsequently, the process again returns to Step S21, whereby printing of the new recording region is possible. In Step S24, windup of the workpiece W onto the wind-up reel 24 starts in synchronization with line feed in the recording operation;

however, optionally, the workpiece W may start being wound up onto the wind-up reel 24 in Step S25 or Step S27. In other words, it is sufficient for the winding of workpiece W onto the wind-up reel 24 to be completed at least prior to starting printing of the new recording region.

The configuration described above affords effects comparable to the first and second embodiments.

Using a recording device 1 like the recording device 1 according to the first embodiment but lacking the delivery-side buffer mechanism 26, optionally, the workpiece stage 5 may be immobile whereas the workpiece-holding unit 60 travels to the downstream end in the same manner as in the workpiece-advancing/retracting method of the first embodiment. In this case, the delivery motor 22 is driven in synchronization with the workpiece-holding unit 60.

In the first to third embodiments, the infeed end nips 28 and the outfeed end nips 29 are respectively composed of freely rotating rollers, but could instead be composed of pairs of clampers. In this case, the workpiece W travels to the lowered position in a state of being nipped by the pairs of clampers, whereby it is possible for the workpiece W (recording region) to be held by suction on the upper face of the stage body 27. In addition, by releasing the suction, supplying compressed air between the workpiece W and the stage body 27, and having the workpiece travel to the raised position, it becomes possible for the slightly floating workpiece to advance or retract from the upper face of the stage body 27, without unnecessary tension being applied to the workpiece. In all other operations, clamping of the workpiece W by the pair of clampers may be released.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a workpiece stage configured and arranged to hold by suction a recording region, the workpiece stage being movable between a first position and a second position, the second position being located downstream of the first position in a first feed direction;

a recording unit configured and arranged to carry out recording in the recording region held onto the workpiece stage by suction;

a workpiece-holding unit movable between a third position and a fourth position, the third position being located on a downstream side of a downstream end of the workpiece stage in the first feed direction while the workpiece stage is located in the second position, the fourth position being located on an upstream side of the downstream end of the workpiece stage in the first feed direction while the workpiece stage is located in the second position, the workpiece-holding unit being further configured and arranged to immovably hold or release a part of the workpiece;

an advancing/retracting unit configured and arranged to cause the workpiece stage and the workpiece-holding unit to travel relatively apart in an extension direction of the workpiece; and a control unit configured to control the recording unit, the workpiece-holding unit, and the advancing/retracting unit, wherein the control unit performs a recording operation to carry out recording in the recording region, a holding operation to immovably hold the part of the workpiece by the workpiece-holding unit that is located in the fourth position in a state in which the workpiece stage is located in the first position subsequent to the recording operation, and an advancing/retracting operation to cause the workpiece-holding unit to move from the fourth position to the third position in a state in which the workpiece stage is located in the first position subsequent to the holding operation so that the recording region where recording has been completed is retracted from the workpiece stage and the recording region where recording has yet to occur is advanced onto the workpiece stage.

2. The recording device according to claim 1, wherein the control unit, between the holding operation and the advancing/retracting operation, is configured to perform a suction-releasing operation to release holding by suction of the recording region.

3. The recording device according to claim 2, further comprising nip sections provided at both ends of the workpiece stage and imparting a prescribed tension to the workpiece, the nip sections being movable in the extension direction in association with the workpiece stage; and a raising/lowering unit configured and arranged to cause upper parts of the nip sections to rise or fall between a lowered position that is a position coplanar with an upper face of the workpiece stage and a raised position that is above the lowered position, subsequent to the suction-releasing operation, the control unit being configured to cause the nip sections to travel to the raised position, and to perform a separation operation to separate the recording region from the workpiece stage.

4. The recording device according to claim 1, wherein in the advancing/retracting operation, the control unit is configured to immobilize the workpiece stage, and to cause the workpiece-holding unit to travel.

5. The recording device according to claim 1, wherein in the advancing/retracting operation, the control unit is configured to immobilize the workpiece-holding unit, and to cause the workpiece stage to travel.

6. The recording device according to claim 1, further comprising a supply/recovery unit configured and arranged to feed the workpiece to the workpiece stage in a reel-to-reel format, the supply/recovery unit including a wind-up device having a wind-up reel configured and arranged to wind up the workpiece, and a wind-up-side buffer mechanism configured and arranged to buffer, with respect to the workpiece stage, the workpiece to be wound onto the wind-up reel.

7. The recording device according to claim 6, wherein the supply/recovery unit further includes a delivery device having a delivery reel configured and arranged to deliver the workpiece, and a delivery-side buffer mechanism configured and arranged to buffer, with respect to the workpiece stage, the workpiece delivered from the delivery reel.

8. A workpiece-advancing/retracting method for a recording device in which a workpiece-holding unit is used for immovably holding an elongated workpiece, the workpiece-advancing/retracting method comprising:

positioning a recording region of a workpiece fed in a first feed direction on a workpiece stage that is movable between a first position and a second position, the second position being located downstream of the first position in the first feed direction, and performing recording;

subsequent to the recording, immovably holding a part of the workpiece by the workpiece-holding unit that is movable between a third position and a fourth position, while the workpiece-holding unit is located in the fourth position in a state in which the workpiece stage is located in the first position, the third position being located on a downstream side of a downstream end of the workpiece stage in the first feed direction while the workpiece stage is located in the second position, the fourth position being located on an upstream side of the downstream end of the workpiece stage in the first feed direction while the workpiece stage is located in the second position; and subsequent to the holding of the part of the workpiece, causing the workpiece-holding unit to move from the fourth position to the third position in a stage in which the workpiece stage is located in the first position, so that the recording region where recording has been completed is retracted from the workpiece stage and the recording region where recording has yet to occur is advanced onto the workpiece stage.

* * * * *